US009370814B2

(12) United States Patent
Rasmussen et al.

(10) Patent No.: US 9,370,814 B2
(45) Date of Patent: Jun. 21, 2016

(54) PRE-NOTCHED DRIP EDGE AND METHOD

(71) Applicant: Quality Edge, Inc., Walker, MI (US)

(72) Inventors: C. Scott Rasmussen, Ada, MI (US); Paul W. Vander Laan, Hamilton, MI (US)

(73) Assignee: QUALITY EDGE, INC., Walker, MI (US)

( * ) Notice: Subject to any disclaimer, the term of this patent is extended or adjusted under 35 U.S.C. 154(b) by 173 days.

(21) Appl. No.: 14/188,014

(22) Filed: Feb. 24, 2014

(65) Prior Publication Data

US 2014/0165685 A1 Jun. 19, 2014

Related U.S. Application Data

(60) Continuation of application No. 13/553,252, filed on Jul. 19, 2012, now Pat. No. 8,683,695, which is a division of application No. 13/050,436, filed on Mar. 17, 2011, now Pat. No. 8,281,521.

(51) Int. Cl.

| | |
|---|---|
| ***B21D 5/08*** | (2006.01) |
| ***E04D 13/04*** | (2006.01) |
| ***E04D 13/158*** | (2006.01) |

(52) U.S. Cl.

CPC ..... *B21D 5/08* (2013.01); *E04D 13/0459* (2013.01); *E04D 13/158* (2013.01); *E04D 2013/0468* (2013.01); *Y10T 29/49623* (2015.01); *Y10T 29/49945* (2015.01)

(58) Field of Classification Search

CPC ..... B21D 5/08; Y10T 29/49945; Y10T 29/49623; E04D 13/15; E04D 13/158; E04D 13/0459; E04D 13/0468

USPC ..... 29/897.3, 525; 72/379.2; 52/60, 96, 97

See application file for complete search history.

(56) References Cited

U.S. PATENT DOCUMENTS

| | | | | |
|---|---|---|---|---|
| 1,327,770 | A | | 1/1920 | Norton |
| 3,137,970 | A | | 6/1964 | Tiernan |
| 3,187,464 | A | * | 6/1965 | Sharp ..... E04D 13/15 52/300 |
| 3,192,670 | A | | 7/1965 | Jones, III |
| 4,980,997 | A | | 1/1991 | Tawzer |
| 5,328,406 | A | | 7/1994 | Morris, Jr. et al. |
| 5,394,722 | A | * | 3/1995 | Meyer ..... B21D 5/08 72/129 |
| 5,414,965 | A | | 5/1995 | Kelley et al. |
| 6,035,587 | A | | 3/2000 | Dressler |
| 8,683,695 | B2 | | 4/2014 | Rasmussen et al. |
| 2005/0005551 | A1 | | 1/2005 | Graham et al. |
| 2005/0086873 | A1 | | 4/2005 | Mares |
| 2007/0074466 | A1 | | 4/2007 | Rasmussen |
| 2007/0214738 | A1 | | 9/2007 | Koessler |

* cited by examiner

*Primary Examiner* — Jason L Vaughan
(74) *Attorney, Agent, or Firm* — Price Heneveld LLP

(57) ABSTRACT

A pre-notched drip edge assembly and related method includes a plurality of drip edge sections interconnected end-to-end to form a continuous water barrier along a roof edge. Each drip edge section has a formed one-piece construction with a top flange and a bottom flange having an inverted L-shape with upper and lower legs. The forward edges of the top flange and the upper leg are integrally interconnected along a folded-over nose having a wedge-shape. A pair of notches are formed in the opposite ends of each drip edge section which extend through the upper edge of the lower leg and the forward edges of the upper leg and the top flange to define flat end tab areas that are inserted into the noses of the next adjacent drip edge sections to horizontally and vertically locate the same along the building roof.

20 Claims, 5 Drawing Sheets

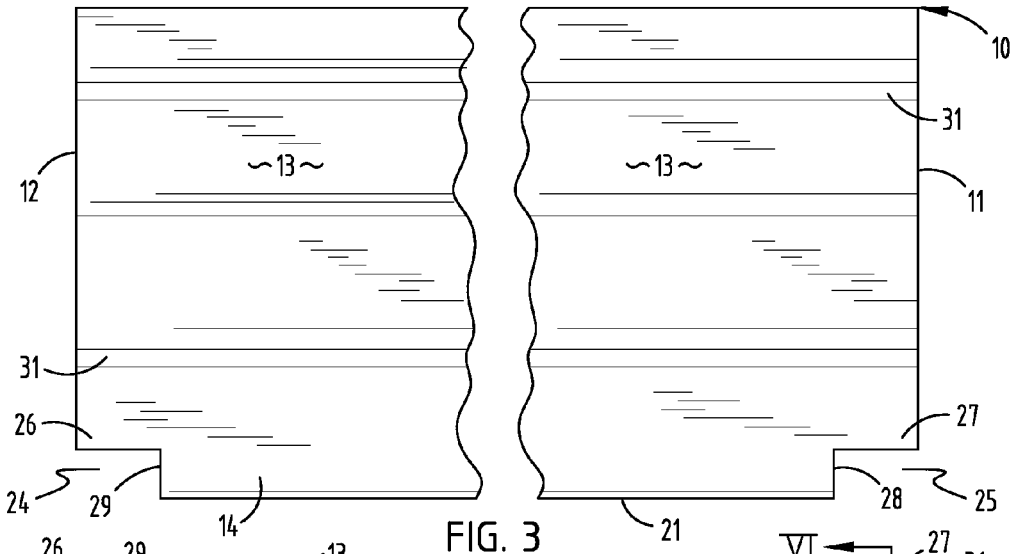
FIG. 3
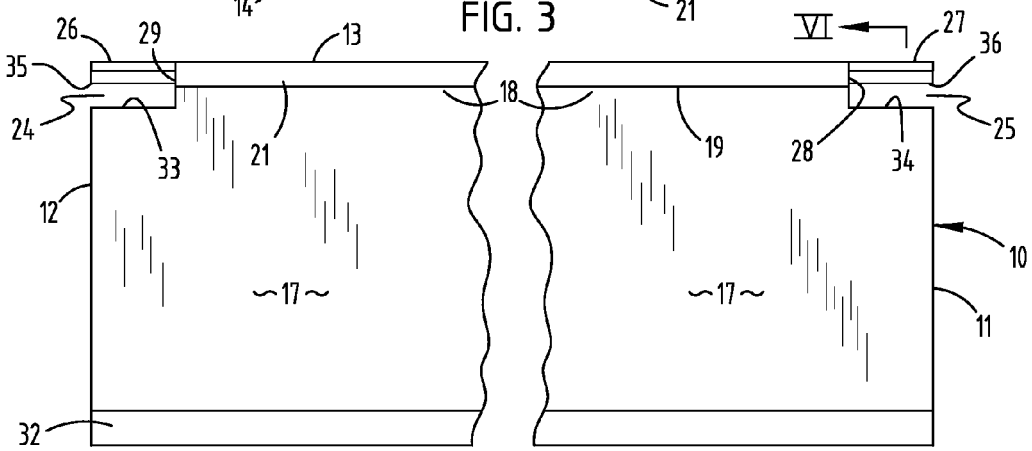
FIG. 4
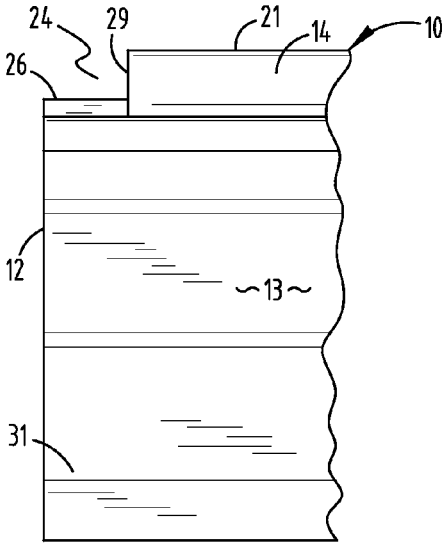
FIG. 5
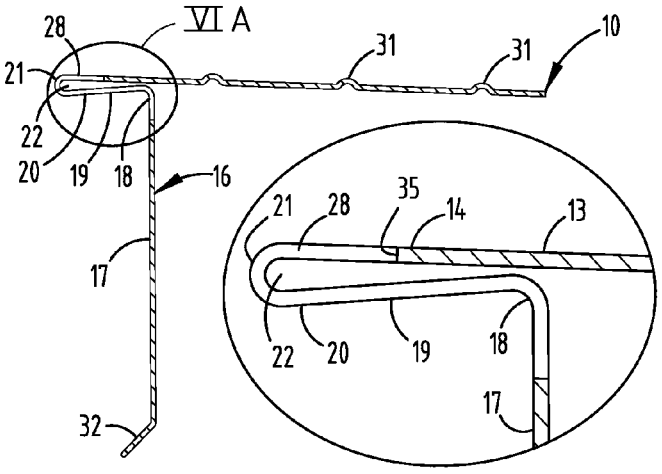
FIG. 6
FIG. 6A

PRE-NOTCHED DRIP EDGE AND METHOD

CROSS REFERENCE TO RELATED APPLICATIONS AND CLAIM TO PRIORITY

The present application is a continuation of commonly assigned, pending U.S. patent application Ser. No. 13/553,252, filed on Jul. 19, 2012, now U.S. Pat. No. 8,683,695, having an issue date of Apr. 1, 2014, entitled A METHOD FOR FORMING A CONTINUOUS RAIN WATER BARRIER, which is a divisional of U.S. Pat. No. 8,281,521, having an issue date of Oct. 9, 2012, entitled PRE-NOTCHED DRIP EDGE ASSEMBLY AND METHOD which is incorporated herein by reference, and claims priority thereto under 35 U.S.C. §119.

BACKGROUND OF THE INVENTION

The present invention relates to drip edges for building roofs and the like, and in particular, to a pre-notched drip edge assembly and related method which is easy to install and improves alignment between the adjacent drip edge sections.

Drip rails or edges are well known in the building industry, and typically comprise L-shaped sheet metal strips which are installed along the bottom edge of a roof to prevent rainwater and/or snow melt from leaking under the shingles or other roofing media. Without such protection around the perimeter of the building roof, capillary action between the roofing material and the roof structure, as well as high winds and other environmental conditions, will result in moisture collecting on the building structure, which ultimately results in leaks and degradation of the integrity of the roof.

Most prior drip edge strips have a flat folded over nose which interconnects the top and bottom flanges, and protrudes outwardly to direct rainwater away from the associated building. An elongate strip of sheet metal or the like is first roll formed to shape, and then cut off into a plurality of individual drip edge sections. During the cut off process, the nose portions of the drip edge sections are completely closed, which makes it difficult to quickly assemble and align the same along the edge of the building roof. Heretofore, the ends of the drip edge sections are nested within one another at each joint so as to ensure a continuous barrier along the building roof edge. This nesting assembly is relatively difficult when the noses of the drip edge sections are completely closed, and can lead to bending the drip edge sections out of shape, which can also cause misalignment between the adjacent drip edge sections. Accordingly, there exists the need for an improved drip edge assembly, which addresses these concerns in a cost effective manner.

SUMMARY OF THE INVENTION

One aspect of the present invention is a pre-notched drip edge assembly for building roofs, comprising a plurality of elongate drip edge sections having opposite ends interconnected in an end-to-end relationship to form a continuous rainwater barrier along an associated building roof edge. Each of the drip edge sections has a formed one-piece construction which includes a top flange portion normally oriented generally horizontally and having a forward edge area. Each drip edge section also has a front flange portion having an inverted generally L-shaped configuration with a lower leg normally oriented generally vertically and having an upper edge area, and an upper leg oriented generally horizontally and having a forward edge area. The forward edge area of the top flange portion and the forward edge area of the upper leg are integrally interconnected along a folded-over nose portion having a generally wedge-shape side elevational configuration which projects outwardly from the lower leg and extends longitudinally along the drip edge section to deflect rainwater away from the building. Each of the drip edge sections also has a pair of notches formed in opposite ends thereof, which extend a preselected distance through the upper edge area of the lower leg, the forward edge area of the upper leg and the forward edge area of the top flange portion, thereby defining generally flat end tab areas on the top flange portion that are inserted into the folded-over nose portion of the next adjacent one of the drip edge sections to horizontally and vertically locate the same for end-to-end interconnection of the drip edge sections along the building roof.

Another aspect of the present invention is a method for making a pre-notched drip edge assembly for building roofs of the type having a plurality of elongate drip edge sections with opposite ends interconnected in an end-to-end relationship to form a continuous rainwater barrier along an associated building roof edge. The method comprises selecting an elongate strip of formable material having a length sufficient to construct a plurality of the drip edge sections therefrom. The method also includes forming a plurality of substantially identical through windows in the strip in a longitudinally aligned and longitudinally spaced apart relationship. After the window forming step, the method also includes forming a top flange in the strip that is normally oriented generally horizontally and has a forward edge area, and also forming a front flange in the strip having an inverted generally L-shaped configuration with a lower leg normally oriented generally vertically and having an upper edge area, and an upper leg normally oriented generally horizontally and having a forward edge area. Furthermore, after the window forming step, the method includes bending the forward edge area of the top flange portion relative to the forward edge area of the upper leg to define a folded-over nose portion having a generally wedge-shaped side elevational configuration which projects outwardly from the lower leg and extends longitudinally along the drip edge section to deflect rainwater away from the building. Furthermore, after the window forming step, the top flange forming step and the front flange forming step, the method includes cutting laterally through the formed strip at locations generally coincident with the center portions of the windows to form a plurality of completed drip edge sections, each with a pair of the notches in the opposite ends thereof which extend a predetermined distance through the upper edge area of the lower leg, the forward edge area of the upper leg and the forward edge area of the top flange portion, and define generally flat end tab areas of the top flange that are shaped for insertion into the folded-over nose portion of the next adjacent one of the drip edge sections. The method also includes inserting one of the flat end tab areas of one of the completed drip edge sections into the folded-over nose portion on the next adjacent one of the completed drip edge sections thereby horizontally and vertically aligning and locating the two completed drip edge sections in a continuous, and in relationship along the building roof. Finally, the method includes operably connecting each of the two completed and assembled drip edge sections to the building, thereby creating a rainwater barrier along the associated building roof edge.

Yet another aspect of the present invention is a method for making a pre-notched drip edge assembly for building roofs of the type having a plurality of elongate drip edge sections with opposite ends interconnected in an end-to-end relationship to form a continuous rainwater barrier along an associated building roof edge. The method includes selecting an elongate strip of formable material having a length sufficient to construct a plurality of the drip edge sections therefrom. The method also includes forming a plurality of substantially identical through windows in the strip in a longitudinally aligned and longitudinally spaced apart relationship. After the window forming step, the method also includes forming a top flange in the strip that is normally oriented generally horizontally and has a front forward edge, and also forming a front flange in the strip having an inverted generally L-shaped configuration with a lower leg normally oriented generally vertically and having an upper edge area, and an upper leg normally oriented generally horizontally and having a forward edge area. After the window forming step, the method also includes bending the forward edge area of the top flange portion relative to the forward edge area of the upper leg to define a folded-over nose portion having a slightly open, generally wedge-shape tapered side elevational configuration which projects outwardly from the lower leg and extends longitudinally along the drip edge section to deflect rainwater away from the building. After the window forming step, the top flange forming step and the front flange forming step, the method also includes cutting laterally through the formed strip at locations generally coincident with the center portions of the windows to form a plurality of completed drip edge sections, each with a pair of notches in the opposite ends thereof which extend a predetermined distance through the upper edge area of the lower leg, the forward edge area of the upper leg and the forward edge area of the top flange portion, and define generally flat end tab areas of the top flange that are shaped for insertion into the folded-over nose portion of the next adjacent one of the drip edge sections. The method also includes interconnecting a plurality of the completed drip edge sections in a continuous end-to-end relationship along the building roof using at least one of first and second interconnecting steps, wherein the first interconnecting step comprises inserting one of the flat end tab areas of one of the completed drip edge sections into the folded-over nose portion of the next adjacent one of the completed drip edge sections thereby horizontally and vertically aligning and locating the two completed drip edge sections in a continuous, end-to-end relationship along the building roof with the end edges of adjacent nose portions of the drip edge sections abutting to define a partially overlapped, abutting assembly condition, and wherein the second interconnecting step comprises inserting the nose portion of one of the completed drip edge sections closely into the slightly open, tapered nose portion of the next adjacent completed drip edge section with a snap lock to define a fully overlapped assembly condition. Finally, the method includes operably connecting each of the completed and assembled drip edge sections to the building thereby creating a rainwater barrier along the associated building roof edge.

The drip edge assembly and related method are efficient in use, economical to manufacture and install, capable of a long operating life, and particularly well adapted for the proposed use.

These and other advantages of the invention will be further understood and appreciated by those skilled in the art by reference to the following written specification, claims, and appended drawings.

BRIEF DESCRIPTION OF THE DRAWINGS

FIG. 3 is a fragmentary top plan view of a drip edge section embodying the present invention.

FIG. 4 is a fragmentary front elevational view of the drip edge section.

FIG. 5 is a fragmentary bottom plan view of the drip edge section.

FIG. 6 is a vertical cross sectional view of the drip edge section.

FIG. 6A is an enlarged cross sectional view of that portion of the drip edge section shown in the balloon VI A, FIG. 6.

DETAILED DESCRIPTION OF THE PREFERRED EMBODIMENTS

Figure 1:
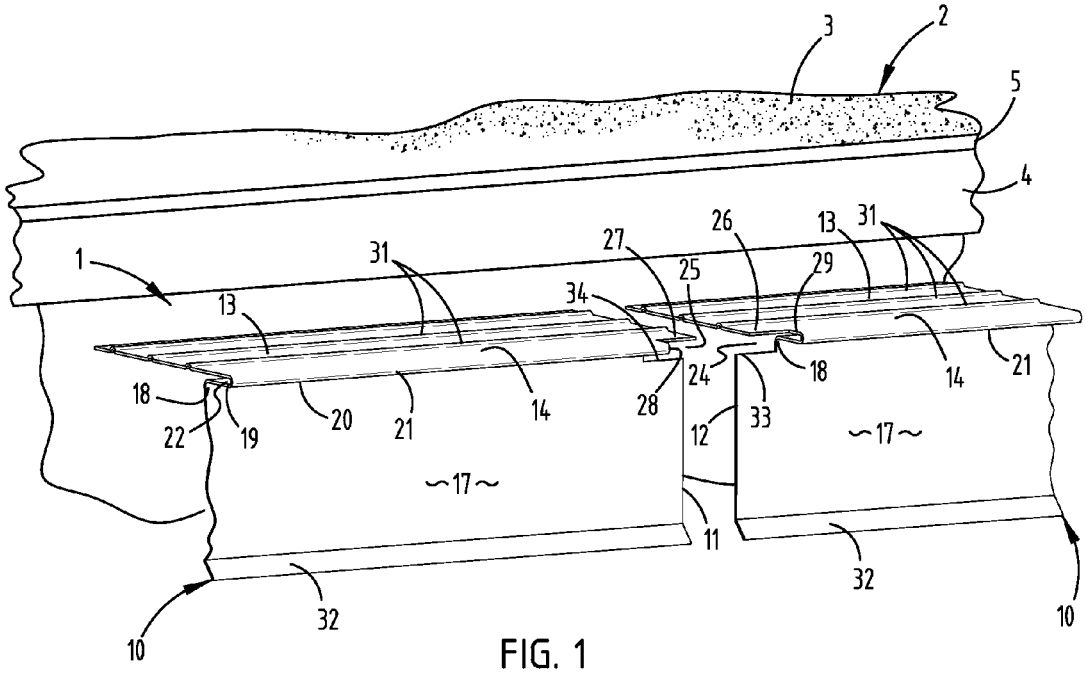
FIG. 1 is a perspective view of a pre-notched drip edge assembly embodying the present invention, shown positioned adjacent a building roof edge prior to assembly.
Figure 2:
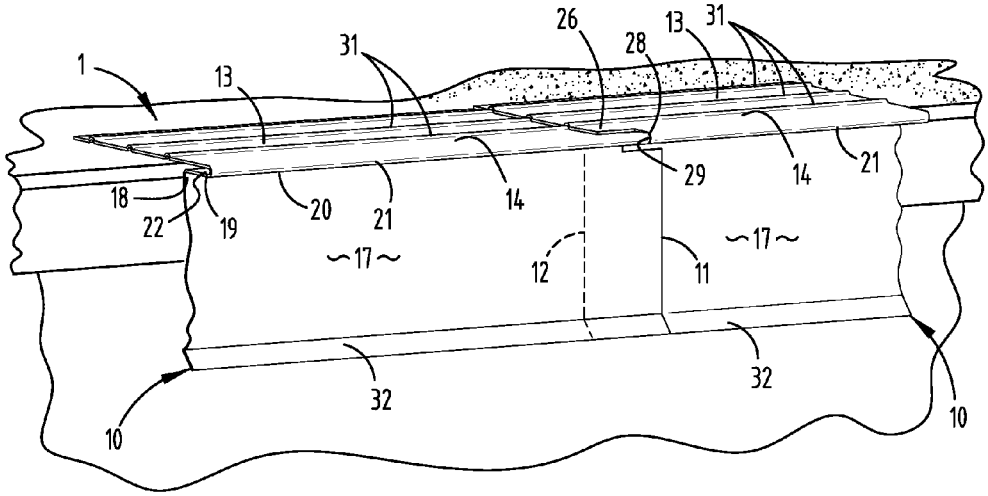
FIG. 2 is a perspective view of the pre-notched drip edge assembly, shown in an assembled condition on the building roof.

For purposes of description herein the terms "upper", "lower", "right", "left", "rear", "front", "vertical", "horizontal", and derivatives throughout as shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIGS. 1 and 2) generally designates a pre-notched drip edge assembly embodying the present invention. Pre-notched drip edge assembly 1 is specifically designed for building roofs, such as the illustrated roof 2 having a plurality of underlayment panels or sheathing 3 and a fascia 4 extending along the bottom edge 5 of roof 2.

Pre-notched drip edge assembly 1 includes a plurality of elongate drip edge sections 10 having opposite ends 11 and 12 which are interconnected in an end-to-end relationship to form a continuous rainwater barrier along the bottom edge 5 of roof 2. Each of the drip edge sections 10 has a formed, one-piece construction, which includes a top flange portion 13 which is normally oriented generally horizontally, and has a forward edge area 14. Each pre-notched drip edge section 10 also includes a front flange portion 16 having an inverted, generally L-shaped configuration with a lower leg 17 which is normally oriented generally vertically, and has an upper edge area 18. Front flange portion 16 also has an upper leg 19 which is normally oriented generally horizontally, and has a forward edge area 20. The forward edge area 14 of the top flange portion 13 and the forward edge area 20 of the upper leg 19 are integrally interconnected along a folded-over nose portion 21, which has a generally wedge-shaped side elevational configuration which projects outwardly from the lower leg 17 and extends longitudinally along the drip edge section 10 to deflect rainwater away from the building. Each of the pre-notched drip edge sections 10 has a pair of notches 24 formed in the opposite ends 11 and 12 of the drip edge section 10, which extend a preselected distance through the upper edge area 18 of the lower leg 17, the forward edge area 20 of the upper leg 19 and a forward edge area 14 of the top flange portion 13, and define two generally flat end tab areas 26 and 27 on the top flange portion, which during installation, are inserted into the folded-over nose portion 21 of the next adjacent ones of the drip edge sections 10 to horizontally and vertically locate the same for quick and accurate end-to-end interconnection of the drip edge sections 10 along the building roof 2.

In the illustrated example, each drip edge section 10 of the pre-notched drip edge assembly 1 has a substantially identical configuration, and is preferably constructed from a strip of relatively thin sheet metal, such as aluminum having a baked-on paint surface or the like on the exterior side thereof. Notches 24 and 25 similarly have a substantially identical shape, size and location on the opposite ends 11 and 12 of each drip edge section 10. As best illustrated in FIGS. 6 and 6A, the folded-over nose portion 21 of each of the drip edge sections 10 has a slightly open, tapered shape which defines a tapered slot area 22 that opens rearwardly, with end edges 28 and 29 that abut the end edges on the nose portions 21 of the next adjacent ones of the drip edge sections 10 to define a partially overlap, abutting assembled condition, as shown in FIGS. 2 and 13-15A, and discussed in greater detail below. The slightly open, tapered shape of the folded-over nose portion 21 also facilitates closely receiving in slot area 22 the end of a next adjacent one of the drip edge section in a nested relationship which snap locks the ends together to define a fully overlapped assembly condition which is illustrated in FIGS. 16-18A, and described in greater detail hereinafter.

In the illustrated example, the top flange portion 13 of each drip edge section 10 has a plurality of raised, longitudinally extending reinforcing channels or ribs 31 which add rigidity to the structure. Also, the lower legs 17 of the illustrated drip edge sections 10 have an angled, forwardly protruding bottom lip portion 32, which serves to direct rainwater away from the associated building. The illustrated notches 24 and 25 open longitudinally, and are defined by end edges 28 and 29, lower edges 34 and 35, and upper edges 35 and 36.

Figure 14:
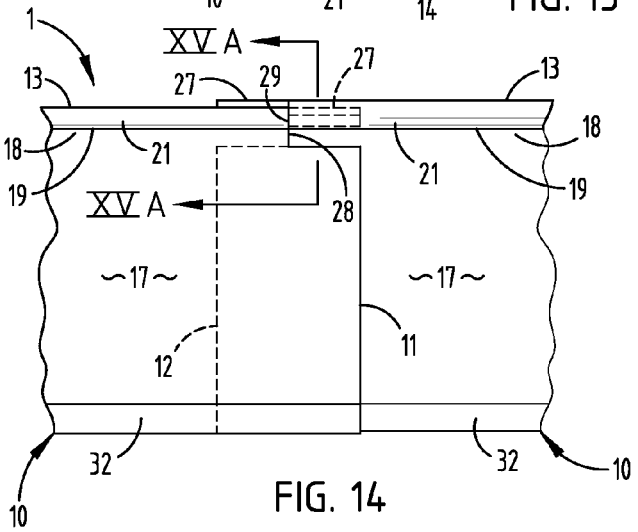
FIG. 14 is a front elevational view of the pair of assembled drip edge sections shown in FIG. 13.
Figure 15A:
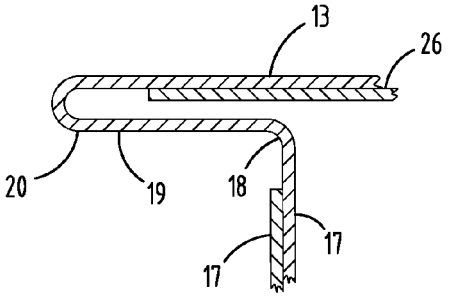
FIG. 15A is a vertical cross sectional view of the pair of assembled pair drip edge sections shown in FIGS. 13-15, taken along the line XVI A XVI A, FIG. 14.
Figure 15:
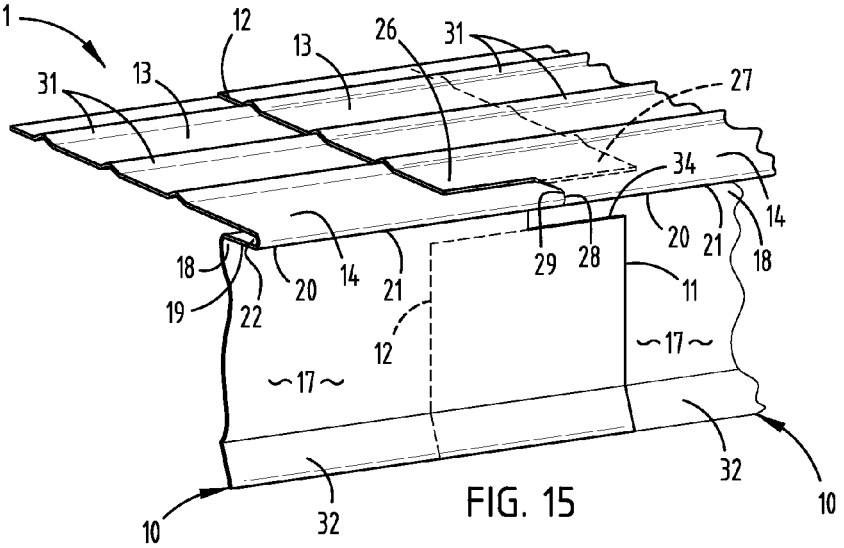
FIG. 15 is a perspective view of the pair of assembled drip edge sections shown in FIGS. 13 and 14.

With reference to FIGS. 5, 14 and 15, in the illustrated example, the end tab areas 26 and 27 of top flange portion 13 have a generally rectangular plan shape (FIG. 5), and are disposed at the opposite forward corners of top flange portion 13, directly behind the associated notches 24 and 25. The forward or leading edges of end tab areas 26 and 27 are defined by notch edges 35 and 36, and extend along the entire length thereof. In one working embodiment of the present invention, end tab areas 26 and 27 have a fore-to-aft width in the range of 0.125-0.250 inches, and a longitudinal length in the range of 0.50 inches, so that when the same are received in the slot areas 22 of the next adjacent nose portion 21, they positively locate the two drip edge sections 10 vertically and horizontally.

Figure 7:
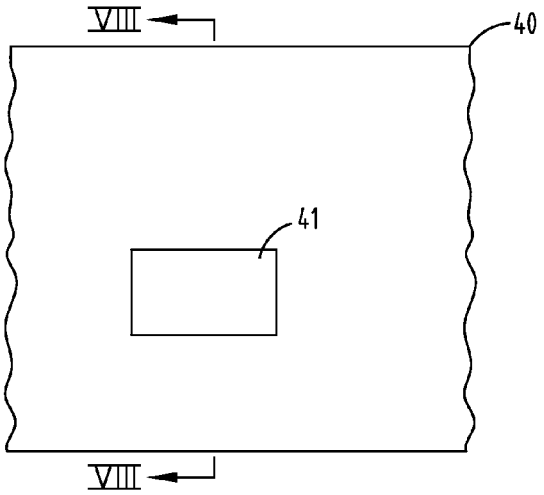
FIG. 7 is partially schematic a top plan view of an elongate strip of formable material through which a window has been formed.
Figure 8:
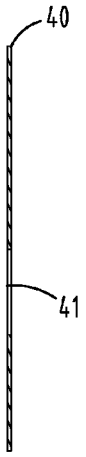
FIG. 8 is a cross sectional view of the strip taken along the line VIII VIII, FIG. 7.
Figure 9:
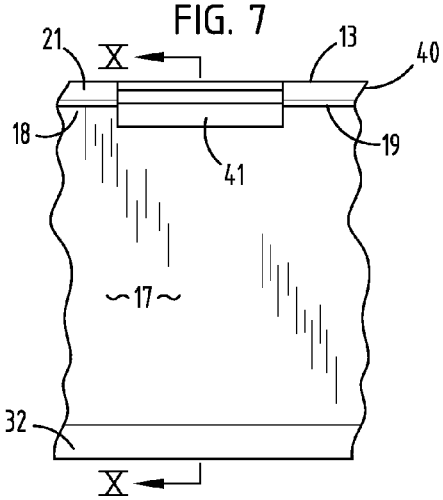
FIG. 9 is a fragmentary front elevational view of the strip after roll forming.
Figure 10:
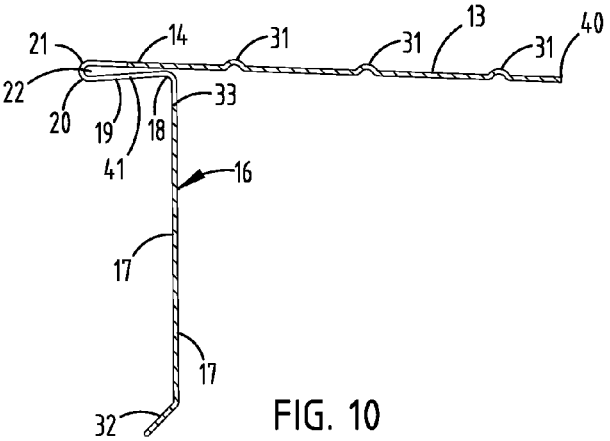
FIG. 10 is a vertical cross sectional view of the form strip taken along the line X X, FIG. 9.
Figure 11:
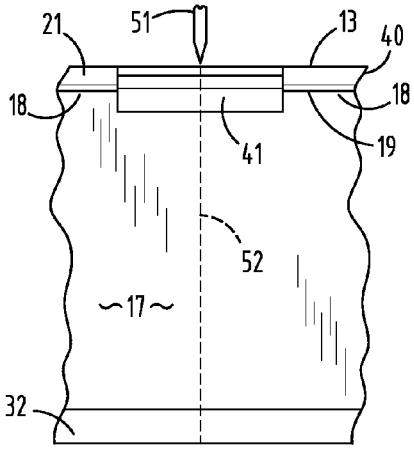
FIG. 11 is a partially schematic front elevational view of the formed strip being cut to lengths.
Figure 12:
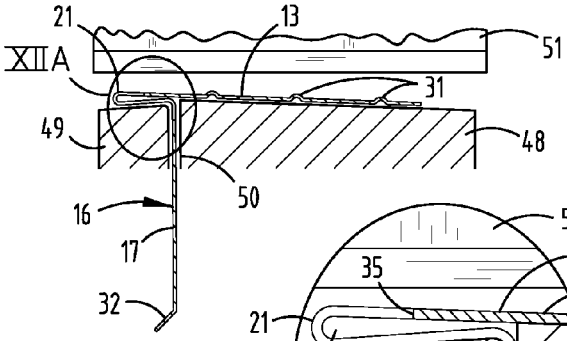
FIG. 12 is a vertical cross sectional view of the formed strip being cut to length.
Figure 12A:
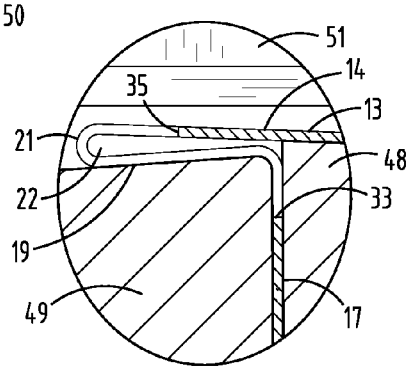
FIG. 12A is an enlarged fragmentary view of that portion of the formed strip being cut to length shown in the balloon XII A, FIG. 12.
Figure 13:
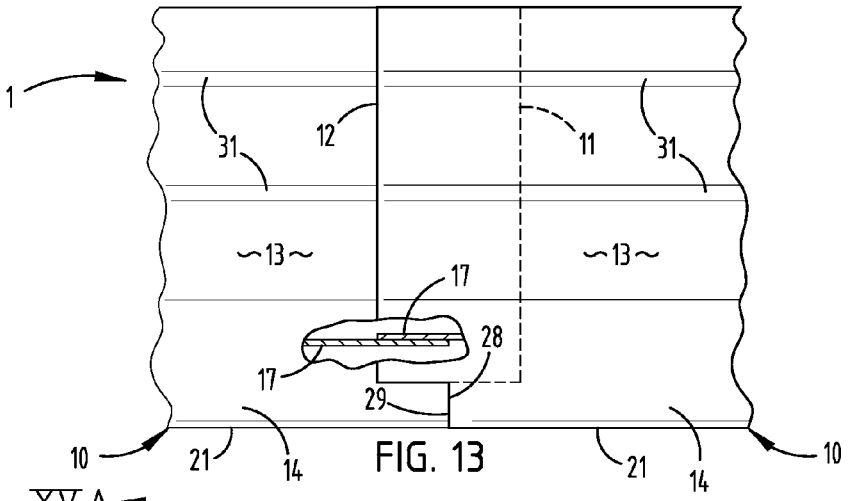
FIG. 13 is a fragmentary top plan view of two drip head sections interconnected end-to-end in a partially overlapped, abutting assembled condition, with a portion thereof broken away to reveal internal construction.

FIGS. 7-12A illustrate a method embodying the present invention for making the drip edge sections 10. With reference to FIG. 7, an elongate strip 40 of sheet metal material or the like, such as aluminum, is unreeled from an associated coil (not shown), straightened, and fed into a stamping machine or the like which forms a series of rectangular windows 41 completely through the flat strip 40 at a location slightly offset from the center of the strip 40. In one working embodiment of the present invention, window 41 has a longitudinal length of approximately 1.00 inches, and a lateral width of approximately 0.54 inches. In the illustrated example, after strip 40 is completely formed to shape and cut into a plurality of individual segments, each of the subject drip edge sections 10 will have a length of approximately ten feet, although it will be understood that other lengths can also be formed, depending on the specific application. Consequently, the illustrated windows 41 are spaced approximately ten feet apart, as measured from the centerline of one window 41 to the centerline of the next adjacent window 41. After the windows 41 have been formed in the flat strip 40, the windowed strip is then passed through a roll forming machine, or is otherwise bent to the formed shape illustrated in FIGS. 7-12A. In the illustrated example, top flange portion 13 is oriented at a predetermined included angle in the range of 85-90 degrees from the front flange portion 16, with top flange portion 13, and assumes a normally, generally horizontal orientation, and front flange portion 16 assumes a generally vertical orientation. After the windowed strip 40 has been roll formed into the formed shape illustrated in FIG. 8, the elongate windowed and formed strip is cutoff lengthwise to define a plurality of individual drip edge sections 10, which in one working embodiment of the present invention, are approximately ten feet in length. More specifically, as best illustrated in FIGS. 11-12A, the windowed and formed strip 40 is positioned in a fixtured anvil, wherein the rearward portion of the top flange portion 13 rests abuttingly on the upper surface of an upper anvil member 48. The upper leg 19 of the front flange portion 16 is abuttingly supported on the upper surface of a forward anvil member 49, and the lower leg 17 of front flange portion 16 extends through a slot 50 located between upper anvil member 48 and forward anvil member 49. In the illustrated example, a vertically reciprocating cutoff blade 51 is positioned above the anvil supported, or fixtured windowed and formed strip 40 at a location immediately above the centerline of the window 41. When the cutoff blade 51 is actuated, it passes through the top flange portion 13, the center of window 41 and then through the lower leg 17 of front flange portion 16, as illustrated by the broken cut line 52 in FIG. 11, thereby forming an individual drip edge section 10 with sidewardly or longitudinally opening notches 24 and 25 at the opposite ends thereof. It is noteworthy that cutoff blade 51 passes through the formed windows 41 in strip 40, so that the folded-over nose portion 21 is not flattened or otherwise distorted from its original, formed designed shape, as shown in FIGS. 7-11, during the cutoff operation. As noted above, in the manufacture of prior art of the drip edge sections, the cutoff operation completely closes off or flattens the nose portion of the drip edge, such that the top flange portion and the front flange portions lay flat against one another. In the present invention, the nose portion 21 remains open with a slightly open, wedge-shaped side elevational configuration which facilitates easy interconnection of adjacent drip edge sections 10 either in a partially overlap, abutting assembly condition, as shown in FIGS. 2 and 13-15, or in a nested, snap locked, fully overlapped assembly condition, as shown in FIG. 16-18.

In operation, a plurality of drip edge sections 10 can be installed along the bottom edge 5 of an associated building roof 10 in a partially overlapped, abutting assembly condition, as shown in FIGS. 2 and 13-15A, in the following fashion. A first drip edge section 10 is positioned over the outer edge of roof 2 and the fascia 4 in the manner illustrated in FIG. 2, and attached to the roof 2 by fasteners that may be driven either through the front flange portion 16 into the fascia 4 and/or through the top flange portion 13 into the sheathing 3 of roof 2. If the roof 2 is pitched, the installer bends the top flange portion 13 of drip edge section 10 relative to the front flange portion 16 along nose portion 21 in a hinge like fashion to conform drip edge section 10 to the exact angle of roof 2. A second drip edge section 10 is placed in a longitudinally aligned relationship with the first installed drip edge section 10 and shifted laterally in a generally horizontal direction, so that the end tab area 27 of the second drip edge section 10 is inserted into the slot area 22 of the nose portion 21 of the first drip edge section 10, which quickly and accurately locates the two drip edge sections 10 both horizontally and vertically relative to one another in a longitudinally aligned condition. The end edges 28 and 29 of the adjacent nose portions 21 abut, thereby forming a stop which automatically indicates that the two drip edge sections 10 are in their proper position for installation on roof 2. In the example illustrated in FIGS. 13-15A, the top and front flanges 13, 16 overlap each other approximately 0.50 inches. The second drip edge section 10 is then attached to the building roof 2 in a manner similar to that of the first drip edge section 10. Additional drip edge sections 10 are then installed in a similar manner until the edge of the roof 2 is completely covered. The notched ends of the first and last drip edge sections 10 may be cut off to form squared off ends.

Figure 16:
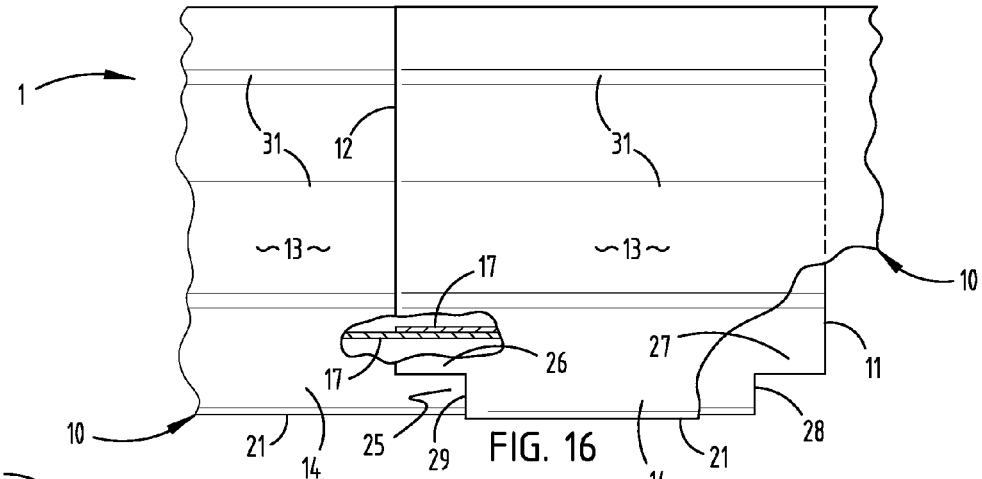
FIG. 16 is a fragmentary top plan view of a pair of drip edge sections shown interconnected in a fully overlapped assembly condition with a portion thereof broken away to reveal internal construction.
Figure 17:
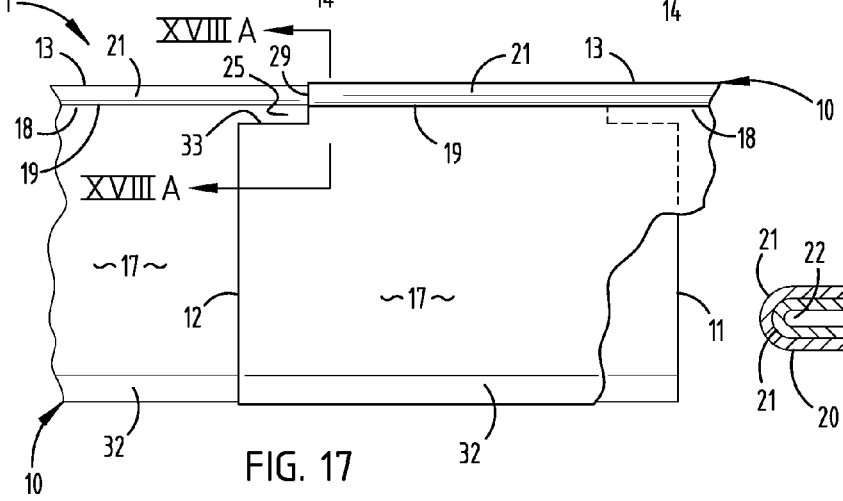
FIG. 17 is a front elevational view of the pair of assembled drip edge sections shown in FIG. 16.
Figure 18A:
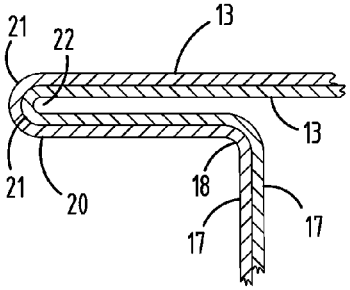
FIG. 18A is a vertical cross sectional view of the pair of assembled drip edge sections shown in FIGS. 16-18, taken along the line XVIII A XVIII A, FIG. 17.
Figure 18:
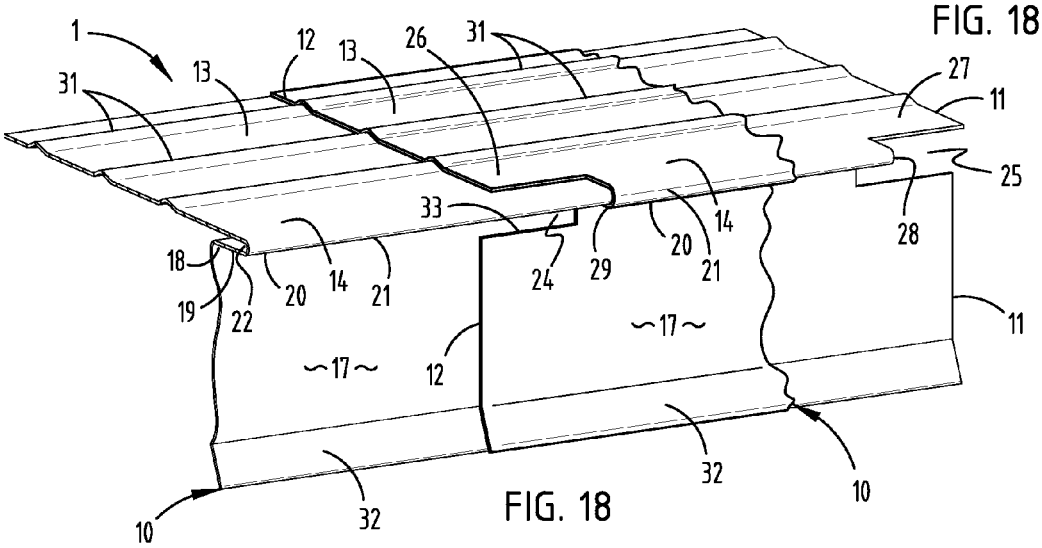
FIG. 18 is a perspective view of the pair of assembled drip edge sections shown in FIGS. 16 and 17.

Alternatively, a plurality of drip edge sections 10 can be installed along the bottom edge 5 of an associated building roof 2 with a more conventional, nested snap-lock in a fully overlapped assembly condition, as shown in FIGS. 16-18, in the following fashion. A first drip edge section 10 is attached to the building roof 2 in a manner similar to that described above, except that the interior end of the drip edge section 10 is left unattached. A second drip edge section 10 is positioned in a fully overlapped condition along the rear surfaces of the first drip edge section 10 with the exterior of the nose portion 21 of the second drip edge section 10 disposed immediately behind the interior of the nose portion 21 of the first drip edge section 10. The adjacent ends 11, 12 of two drip edge sections 10 are then converged into a nested relationship, so that they snap lock together in a fully overlapped assembly condition. Because the nose portion 21 of the drip edge sections 10 is slightly open with a tapered shape, it is easy to snap the two drip edge sections 10 together in a fully overlapped condition.

In the example shown in FIGS. 16-18, the top and front flanges 13, 16 overlap several inches, although it is to be understood that this amount can be readily changed by the installer, since there is no longitudinal stop feature with this assembly technique. The joined or overlapped areas of the drip edge sections 10 are then fastened to the roof 2. Additional drip edge sections 10 are then installed in a similar manner, until the bottom edge 5 of the roof 2 is completely covered.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. In a method for forming a continuous rainwater barrier along at least one edge portion of a building roof, the improvement comprising:

selecting an elongate strip of formable material having a length sufficient to construct a plurality of drip edge sections therefrom;

forming a plurality of substantially identical through windows in the strip;

after said window forming step, roll forming a top flange in the strip that is normally oriented generally horizontally and has a forward edge area;

after said window forming step, roll forming a front flange in the strip with an inverted generally L-shaped configuration having a lower leg normally oriented generally vertically and having an upper edge area, and an upper leg having a forward edge area;

after said window forming step, bending the forward edge area of the top flange portion relative to the forward edge area of the upper leg to define a folded-over tapered nose portion which projects generally horizontally outwardly from the lower leg and extends longitudinally along the drip edge section to deflect rainwater outwardly and downwardly away from an associated building; and after said window forming step, said top flange forming step and said front flange forming step, cutting laterally through the formed strip at locations generally coincident with center portions of the windows to form a plurality of completed drip edge sections, each with a pair of longitudinally opening notches in and completely through the opposite ends thereof which extend a predetermined distance through the upper edge area of the lower leg, the forward edge area of the upper leg and the forward edge area of the top flange portion, and define generally flat end tab areas of the top flange that are shaped for insertion into the folded-over nose portion of a next adjacent one of the drip edge sections.

2. A method as set forth in claim 1, including:

placing the exterior of the folded-over tapered nose portion of the one of the completed drip edge sections immediately behind the interior of the folded-over tapered nose portion of a second, next adjacent, one of the completed drip edge sections.

3. A method as set forth in claim 2 including:

converging the adjacent competed drip edge sections into a nested relationship so that they snap lock together.

4. A method as set forth in claim 3, including:

operably connecting the first and second completed and assembled drip edge sections to the associated building, thereby creating a continuous rainwater barrier along the one edge portion of the building roof.

5. A method as set forth in claim 4, wherein:

said bending folded-over tapered nose portion step comprises forming each of the folded-over tapered nose portions of the drip edge sections with a slightly open shape.

6. A method as set forth in claim 5, wherein:

said elongate strip selecting step comprises selecting an elongate strip of sheet metal with a pre-painted exterior surface.

7. A method as set forth in claim 6, wherein:

said top flange forming step includes forming at least one longitudinally extending reinforcing member in the top flange to add rigidity to the drip edge sections.

8. A method as set forth in claim 7, wherein:

said front flange forming step includes forming a lower leg portion on the front flange portion with an angled, forwardly protruding bottom lip portion to direct rainwater away from the associated building.

9. A method as set forth in claim 1, including:

operably connecting the first and second completed and assembled drip edge sections to the building, thereby creating a rainwater barrier along the one edge portion of the building roof.

10. A method as set forth in claim 1, wherein:

said elongate strip selecting step comprises selecting an elongate strip of sheet metal with a pre-painted exterior surface.

11. A method as set forth in claim 1, wherein:

said top flange forming step includes forming at least one longitudinally extending reinforcing member in the top flange to add rigidity to the drip edge sections.

12. A method as set forth in claim 1, wherein:

said front flange forming step includes forming a lower leg portion on the front flange portion with an angled, forwardly protruding bottom lip portion to direct rainwater away from the associated building.

13. A method for making pre-notched drip edge sections for building roofs comprising:

selecting an elongate strip of formable material having a length sufficient to construct a plurality of drip edge sections therefrom;

forming a plurality of substantially identical through windows in the strip;

after said window forming step, roll forming a top flange in the strip that is normally oriented generally horizontally and has a forward edge area;

after said window forming step, roll forming a front flange in the strip with an inverted generally L-shaped configuration having a lower leg normally oriented generally vertically and having an upper edge area, and an upper leg having a forward edge area;

after said window forming step, bending the forward edge area of the top flange portion relative to the forward edge area of the upper leg to define a folded-over nose portion which projects generally horizontally outwardly from the lower leg and extends longitudinally along the drip edge section to deflect rainwater outwardly and downwardly away from an associated building; and after said window forming step, said top flange forming step and said front flange forming step, cutting laterally through the formed strip at locations generally coincident with center portions of the windows to form a plurality of completed drip edge sections, each with a pair of longitudinally opening notches in and completely through the opposite ends thereof which extend a predetermined distance through the upper edge area of the top flange portion, and define generally flat end tab areas of the top flange that are shaped for insertion into the folded-over nose portion of a next adjacent one of the drip edge sections.

14. A method as set forth in claim 13, wherein:

said bending folded-over nose portion step comprises forming each of the folded over nose portions of the drip edge sections with a slightly open, tapered shape.

15. A method as set forth in claim 13, wherein:

said elongate strip selecting step comprises selecting an elongate strip of sheet metal with a pre-painted exterior surface.

16. A method as set forth in claim 13, wherein:

said top flange forming step includes forming at least one longitudinally extending reinforcing member in the top flange to add rigidity to the drip edge sections.

17. A method as set forth in claim 13, wherein:

said front flange forming step includes forming a lower leg portion on the front flange portion with an angled, forwardly protruding bottom lip portion to direct rainwater away from the associated building.

18. A method for forming a continuous rainwater barrier along at least one edge portion of a building roof, comprising:

roll forming at least first and second elongate drip edge sections each having a generally rigid construction with a top flange portion normally oriented generally horizontally and having a forward edge area, a front flange portion having an inverted generally L-shaped configuration with a lower leg normally oriented generally vertically and having an upper edge area, and an upper leg having a forward edge area, with the forward edge area of the top flange portion and the forward edge area of the upper leg being interconnected along a generally rounded nose portion which projects generally horizontally outwardly from the lower leg, and extends longitudinally along the drip edge section to deflect rainwater outwardly and downwardly away from the associated building, and a pair of longitudinally opening notches disposed in and completely through the opposite ends of the first and second drip edge sections, that extend a preselected distance through the upper edge area of the lower leg, the forward edge area of the upper leg and the forward edge area of the top flange portion adjacent ends of first and second ones of the drip edge sections, and define generally flat end tab areas on each of the top flange portions;

interconnecting in and end-to-end relationship along the at least one edge portion of the building roof adjacent ends of the first and second drip edge sections by converging the same with the top flange portion of the second drip edge section overlying the top flange portion of the first drip edge section, with the front flange portion of the second drip edge section underlying the front flange portion of the first drip edge section, and with the flat end tab on the top flange portion of the first drip edge section inserted into the nose portion of the second drip edge section, until the opposite end edges of the nose portions of the first and second drip edge sections generally abut, thereby both horizontally and vertically locating and aligning the adjacent ends of the first and second drip edge sections, and contemporaneously forming a continuous rainwater barrier therebetween; and operably supporting the first and second drip edge sections on the building roof to retain the same in the interconnected relationship along the one edge portion of the building roof.

19. A method as set forth in claim 18, wherein:

said drip edge forming step comprises forming each of the rounded nose portions with a slightly open, tapered shape.

20. A method as set forth in claim 18, wherein:

said drip edge forming step comprises selecting a material having pre-finished exterior surfaces.

* * * * *